US006714653B1

(12) United States Patent
Magyari et al.

(10) Patent No.: US 6,714,653 B1
(45) **Date of Patent: *Mar. 30, 2004**

(54) SOUND CAPTURING METHOD AND DEVICE

(76) Inventors: Douglas Peter Magyari, 4245 Buckingham, Royal Oak, MI (US) 48073; David Keith Magyari, 27403 Dartmouth, Madison Heights, MI (US) 48071

( * ) Notice: Subject to any disclaimer, the term of this patent is extended or adjusted under 35 U.S.C. 154(b) by 0 days.

This patent is subject to a terminal disclaimer.

(21) Appl. No.: 09/031,356

(22) Filed: Feb. 26, 1998

Related U.S. Application Data

(63) Continuation of application No. 08/660,526, filed on Jul. 7, 1996, now Pat. No. 5,793,873.

(51) Int. Cl.[7] ..... H04R 5/00
(52) U.S. Cl. ..... 381/26; 381/91; 381/122
(58) Field of Search ..... 381/26, 122, 91, 381/309

(56) References Cited

U.S. PATENT DOCUMENTS

| | | | | |
|---|---|---|---|---|
| 2,563,010 A | | 8/1951 | De Boer et al. | |
| 3,870,820 A | * | 3/1975 | Suzuki et al. | 381/365 |
| 3,985,960 A | | 10/1976 | Wallace, Jr. | |
| 4,074,084 A | | 2/1978 | van den Berg | |
| 4,388,494 A | | 6/1983 | Schone et al. | |
| 4,393,270 A | | 7/1983 | van den Berg | |
| 4,442,323 A | * | 4/1984 | Yoshida et al. | 381/95 |
| 4,741,035 A | * | 4/1988 | Genuit | 381/26 |
| 5,031,216 A | | 7/1991 | Gorike et al. | |
| 5,105,822 A | | 4/1992 | Stevens et al. | |
| 5,511,132 A | | 4/1996 | Yoshimi | |

FOREIGN PATENT DOCUMENTS

EP 050 100 A2 4/1982

OTHER PUBLICATIONS

John Sunier, "A History of Binaural Sound", Audio, Mar. 1986, pp. 36–46.

* cited by examiner

*Primary Examiner*—Xu Mei
(74) *Attorney, Agent, or Firm*—Brooks Kushman P.C.

(57) ABSTRACT

A sound capturing method and device for use in making recordings having improved three-dimensional imagery during playback. Vibration information is detected from a body portion through the use of a crystal microphone for generating a first signal corresponding to a vibrational frequency of the body portion in response to a received sound wave. Direct sound information is detected from the body portion through the use of a condenser microphone affixed thereto at a second location for generating a second signal corresponding to a frequency of the received sound wave. The first and second locations are in proximity to one another such that a sound wave will reach each location at substantially the same time. Alternatively, the signals received at either location may be processed or time-delayed such that sound waves are recorded from each location at substantially the same time. The resultant first and second signals may be combined through the use of a mixer and then put into a conventional sound recording device.

2 Claims, 8 Drawing Sheets

SOUND CAPTURING METHOD AND DEVICE

CROSS-REFERENCE TO RELATED APPLICATION

This application is a con of U.S. application Ser. No. 08/660,526, filed Jul. 7, 1996, now issued as U.S. Pat. No. 5,793,873.

TECHNICAL FIELD

This invention relates to a method and device for capturing sound for use in recording phonorecords, compact disks, and the like having improved three-dimensional imagery during playback.

BACKGROUND OF THE INVENTION

Since the development of dual-channel or "stereo" transmission systems, audio system designers have sought ways to improve upon the dimensionality of source recordings. There are currently two schools of thought on how to achieve this goal: Algorithmic manipulation; and binaural recording. In the algorithmic approach, elaborate processing techniques are utilized including, for example, phase shifting and EQ delays so as to create the illusion of height and depth. The quality of the output signal in this approach, however, is directly dependent on the quality of the input data. High quality three-dimensional imagery can therefore only be achieved if high quality input data is utilized. As those skilled in the art will recognize, however, this is generally not the case in conventional recording techniques. Moreover, it has been found that even the slightest over-processing may sufficiently distort the output signal so as to render it displeasing to listeners.

Binaural recording techniques, on the other hand, have shown greater promise as a method for improving source recording dimensionality. A historical account of binaural sound applications and processing techniques may be found in the article "A History of Binaural Sounds" by John Sunier, published in the March, 1986 edition of *Audio Maqazine*. As discussed therein, from approximately 1936 to 1983, binaural devices and processing techniques remained relatively unchanged. In operation, a mannequin or similar dummy head was utilized as a source recording device having a pair of microphones separated by a baffle so as to form right and left channels.

The 1980's brought variations in this traditional device including, for example, full ear canals which created a redundant complication. Namely, the use of a full ear canal in the sound recording device coupled with the listener's own full ear canal, was found to greatly distort the received signal. Other variations included, for example, the use of multiple microphones. This approach, however, has been found most suitable only in those situations where multiple speakers are also being used such as, for example, in 360° surround sound theaters found in theme parks and the like. Other variations on the binaural approach may also be found, for example, in U.S. Pat. No. 3,985,960, issued to Wallace, Jr.; U.S. Pat. No. 4,074,084, issued to van den Berg; U.S. Pat. No. 4,388,494, issued to Schone et al.; U.S. Pat. No. 4,393,270, issued to van den Berg; U.S. Pat. No. 4,741,035, issued to Genuit; and U.S. Pat. No. 5,105,822, issued to Stevens et al. Each of these patents discloses a method of sound reproduction which utilizes a binaural approach.

While these variations show marked improvements over traditional binaural recording techniques, they nonetheless result in sound recordings which lack the desired height/depth components necessary to achieve full three-dimensional imagery. Applicant has found that the prior art devices lack this component because of a fundamental misunderstanding regarding the way in which humans hear. While traditional devices were developed based on the understanding that humans hear primarily with their ears, Applicant has found in practice that the human body, and in particular, a body vibration component plays an important role. If properly harnessed, this vibration component will result in sound recordings having markedly improved source dimensionality.

Consequently, a need exists for a sound capturing method and device which utilizes both direct sound and body vibration information for use in source recordings so as to provide improved three-dimensional imagery during playback.

DISCLOSURE OF THE INVENTION

It is an object of the present invention to overcome the limitations of the prior art by providing a sound capturing method and device which mimics the human sound capturing process.

A more specific object of the present invention is the provision of a sound capturing method and device for detecting and combining vibration information and direct sound information received at respective first and second locations on a body portion, the locations being in sufficient proximity to one another such that a sound wave will reach each location at substantially the same time. If the locations cannot be in sufficient proximity to allow for the sound wave to reach each location at substantially the same time, the signal received at either location may be processed or time-delayed such that sound waves are recorded from each location at substantially the same time.

Yet another more specific object of the present invention is the provision of a sound capturing method and device which detects and combines vibration information and direct sound information through the use of at least one crystal microphone/condenser microphone pair affixed to a vibratory body, the components being positioned in sufficient proximity to one another such that a sound wave will reach the crystal microphone and the condenser microphone at substantially the same time. Again, if the crystal microphone cannot be placed in sufficient proximity to the condenser microphone to allow for a sound wave to reach each location at substantially the same time, the signal received at either location may be processed or time-delayed such that sound waves are recorded from each location at substantially the same time.

Still another object of the present invention is the provision of a sound capturing method and device which detects body vibration information through the use of a vibratory body having a torso portion which includes a pair of plates adapted to vibrate over a full range of frequencies without significant oscillation and combines the same with direct sound information.

It is a further object of the present invention to provide a recording which includes combined vibration information and direct sound information fixed in a tangible medium, both the vibration information and the sound information being generated in response to a sound wave, the vibration information corresponding to the vibrational frequency of a vibratory body at a first location and the direct sound information generated directly from the sound wave at a second location, the second location being in sufficient proximity to the first location such that the sound wave will reach each location at substantially the same time. If the locations cannot be in sufficient proximity to allow for the sound wave to reach each location at substantially the same time, the signal received at either location may be processed or time-delayed such that sound waves are recorded from each location at substantially the same time.

In accordance with the invention, a sound capturing method is provided which includes the steps of detecting vibration information from a body portion at a first location to generate a first signal corresponding to a vibrational frequency of the body portion in response to a received sound wave. Direct sound information is further detected from the body portion at a second location to generate a second signal corresponding to a frequency of the received sound wave. The second location is in sufficient proximity to the first location such that a sound wave will reach each location at substantially the same time. Alternatively, the signal received at either location may be processed or time-delayed such that sound waves are recorded from each location at substantially the same time.

In a preferred embodiment, the vibration information is detected through the use of a crystal microphone and the direct sound information is detected through the use of at least one electret microphone. The at least one electret microphone is preferably, but not necessarily, co-located with the crystal microphone. Once the vibration information and the direct sound information has been detected, it is combined through the use of a mixer. In a stereo version, vibration information and direct sound information is detected and combined from each side of the vibratory body so as to provide a dual channel output.

In carrying out the above method, a sound capturing device is further provided for recording a phonorecord such as an electromagnetic cassette, an LP, a compact disc, or the like. In its simplest form, the sound capturing device comprises a body portion having a first microphone such as a crystal microphone affixed thereto at a first location for generating a first signal corresponding to a vibrational frequency of the body portion in response to a received sound wave. At least one secondary microphone, such as a condenser microphone, is affixed to the body portion at a second location for generating a second signal corresponding to a frequency of the received sound wave. In keeping with the invention, the second location is in sufficient proximity to the first location such that the sound wave will reach each location at substantially the same time. Alternatively, the signal received at either location may be processed or time-delayed such that sound waves are recorded from each location at substantially the same time. As noted above, the crystal microphone and the at least one secondary microphone are preferably, but not necessarily, co-located. The resultant first and second signals may be combined through the use of a mixer.

In a preferred embodiment of the sound recording device, the body portion is integral and is geometrically configured to simulate a human head and torso. The torso portion includes a pair of outwardly extending plates each having a plurality of ribs of varying mass which are adapted to vibrate over a range of audio frequencies without significant oscillation.

In a stereo version of the invention, the body portion of the above-described sound recording device includes a right side and a left side which may be delineated, for example, by an internal baffle. A first crystal microphone is affixed to the right side of the body portion at a first location and a first condenser microphone is affixed to the right side of the body portion at a second location. Still further, a second crystal microphone is affixed to the left side of the body portion at a first location and a second condenser microphone is affixed to the left side of the body portion at a second location. The crystal microphone/condenser microphone pairs on each side of the body portion are disposed relative to one another such that a sound wave will reach each of the microphones making up the pair at substantially the same time. Alternatively, the signal received at either location may be processed or time-delayed such that sound waves are recorded from each location at substantially the same time. A mixer may also be provided for combining the vibration and direct sound information on respective sides of the body portion.

In a preferred stereo embodiment, multiple (two or more) condenser microphones may be affixed in groups to the right and left sides of the head portion at respective third, fourth, etc. locations. The groups of condenser microphones are disposed relative to their corresponding crystal microphone (right or left side) such that a sound wave will reach the group of condenser microphones and the corresponding crystal microphone at substantially the same time. Alternatively, the signal received at either location may be processed or time-delayed such that sound waves are recorded from each location at substantially the same time. Again, in keeping with the invention, the groups of condenser microphones are preferably, but not necessarily, co-located with their corresponding crystal microphone.

These and other objects, features and advantages of the present invention may be more readily apparent from a review of the following detailed description of the best mode for carrying out the invention when taken in connection with the accompanying drawings.

BEST MODE(S) FOR CARRYING OUT THE INVENTION

Figure 1:
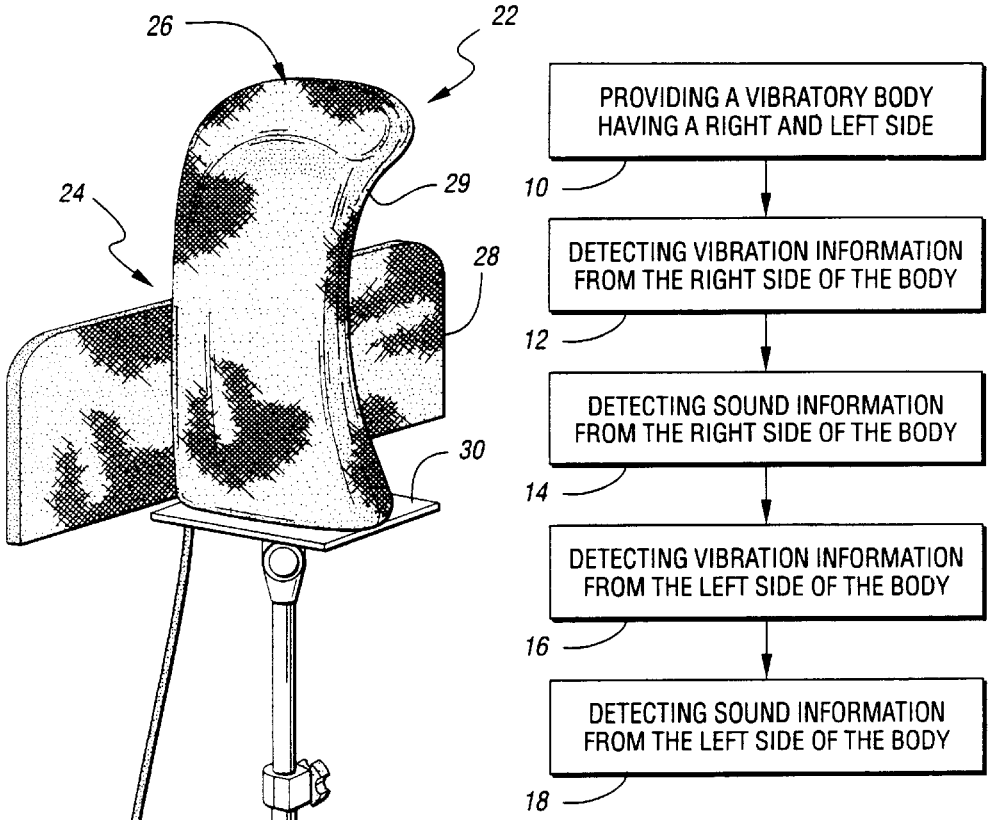
FIG. 1 is a block diagram of the method steps of the present invention.

The sound capturing method of the present invention is specifically directed to recording phono-records such as electromagnetic cassettes, LPs, compact discs, and the like. The method may be described generally by reference to FIG. 1 and includes the steps of providing 10 a vibratory body having a right side and a left side. Vibration information may be captured or detected 12 from the body in response to a sound wave from the right side of the vibratory body at a first location to generate a first signal. Sound information may further be directly detected 14 in response to the sound wave from the right side of the vibratory body at a second location so as to generate a second signal.

In keeping with the invention, the second location is in sufficient proximity to the first location such that the sound wave will reach each location at substantially the same time. Vibration information is further detected 16 from the body in response to the sound wave from the left side of the vibratory body at a first location to generate a third signal. Still further, sound information is directly detected 18 from the sound wave from the left side of the vibratory body at a second location to generate a fourth signal. Again, the second location is in sufficient proximity to the first location such that the sound wave will reach each location at substantially the same time.

With respect to the proximity of the second location to the first location, it is intended that the sound wave will reach each location at substantially the same time. If the locations cannot be in sufficient proximity to allow for the sound wave to reach each location at substantially the same time, the signal received at either location may be processed or time-delayed such that sound waves are recorded from each location at substantially the same time.

The method described above is of course directed to stereo recording. If a mono recording is desired, the output signals from the right and left channel may be summed to mono using conventional signal summation techniques which are known to those skilled in the art and need not be discussed here in further detail. Alternatively, direct sound information and body vibration information may be detected from a single channel. For example, a single crystal microphone/condenser microphone pair may be mounted in front of the head portion or other suitable location depending upon the desired recording and applicable parameters.

Figure 2:
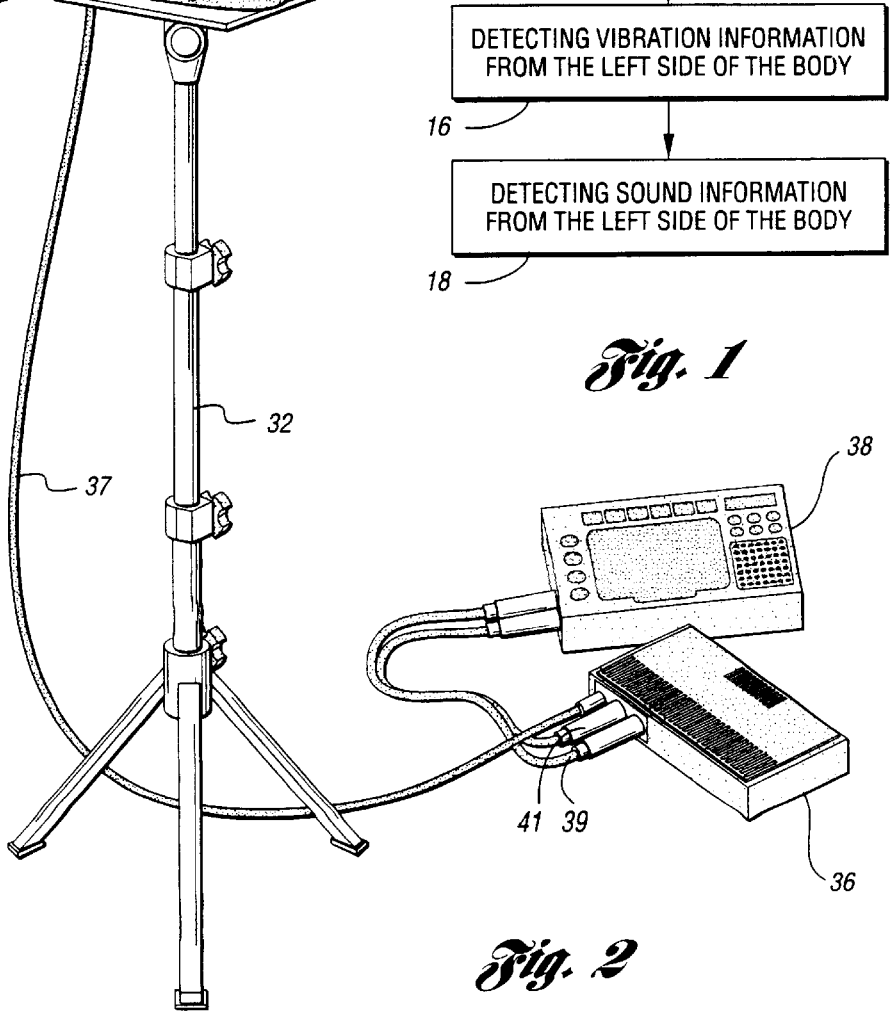
FIG. 2 is a perspective view of the sound recording device of the present invention shown with a protective covering.
Figure 3:
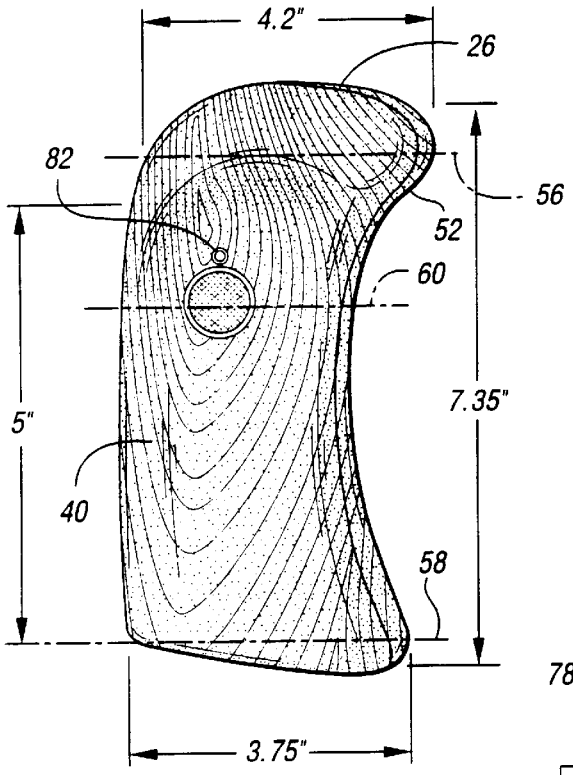
FIG. 3 is a right side elevational view of a first preferred embodiment of the head portion of the sound recording device of FIG. 1.
Figure 4:
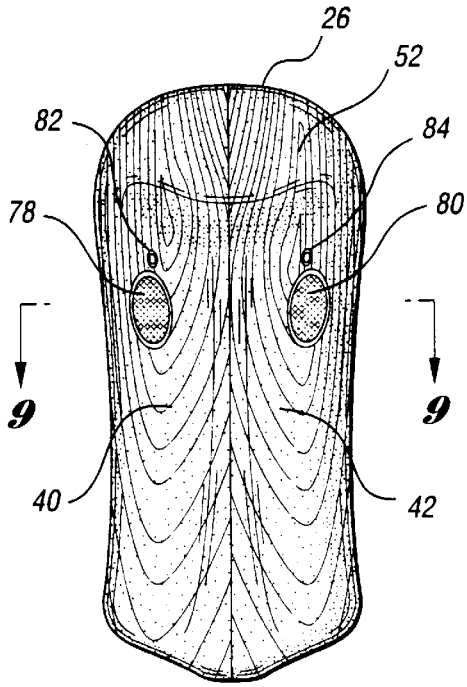
FIG. 4 is a front elevational view of the head portion of the sound recording device of FIG. 3.

Turning to FIG. 2 of the drawings, there is shown a stereo embodiment of a sound recording device for carrying out the method of the above-described invention. The device, designated generally by reference numeral 22, comprises a body vibration system 24 including a head portion 26 and a torso portion 28, both of which are shown with a protective cover 29 to protect the internal components. Vibration system 24 may, of course, be covered in whole or in part with any suitable material including, for example, polyethylene, polyurethane, nylon, plastic, etc. System 24 may also be left uncovered depending on the needs of the sound engineer, and the applicable recording and environmental conditions.

Head portion 26 may be mounted by screws (not shown) or other suitable fixing means such as nylon bolts or the like to a dampening plate 30 or other suitable platform. As shown, dampening plate 30 is preferably, but not necessarily, attached to an adjustable tripod 32. Plate 30 is shown in greater detail in FIG. 7 and includes a plurality of vibration dampening elements 34 which are rubber mounted shock absorbers.

Device 22 is adapted to be connected to a mixer 36 via input cable 37. Mixer 36 is operative to combine the direct sound information and the body vibration information detected by body vibration system 24 into discrete right and left channels (i.e., right channel: right side direct sound information and right side body vibration information; and left channel: left side direct sound information and left side body vibration information). Mixer 36 is in turn connected with a conventional sound recording device 38 via input cables 39 and 41 (right and left channels).

A first preferred embodiment of head portion 26 is shown in FIGS. 3–6 and 9 of the drawings. Head 26 is preferably made of a highly resonant material such as, for example, Engleman Spruce wood. Depending upon the application, however, any suitable material may be used including, for example, plastic, ceramic, as well as other types of wood and composite materials. Head portion 26 is also preferably, but not necessarily, comprised of a two-piece substantially solid construction having a right side 40 and a left side 42 which are affixed together by nylon screws (not shown) or the like and separated by an internal baffle 44 so as to create two distinct left and right systems. Baffle 44 is comprised of polyurethane or any other material which may be suited to this particular purpose. Although of preferably solid construction, each of the right sides 40 and 42 of head portion 26 includes a hollowed-out cavity 46 and 48, respectively, for receiving and housing internal electrical components as described in further detail below. Cavities 46 and 48 may also, but not necessarily, be covered by a protective covering 50 such as polyethylene or the like, to prevent contaminants from entering therein. One or more cavities (not shown) may also be carved out of head portion 26 to allow for insertion of other density materials such as polyfoam and the like to more closely replicate the vibrational characteristics of the human head.

Figure 5:
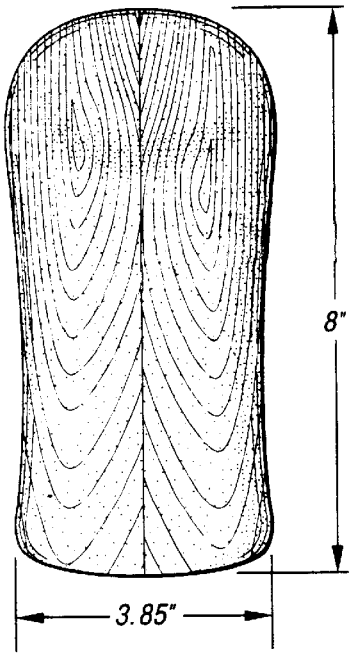
FIG. 5 is a rear elevational view of the head portion the sound recording device of FIGS. 3 and 4.
Figure 6:
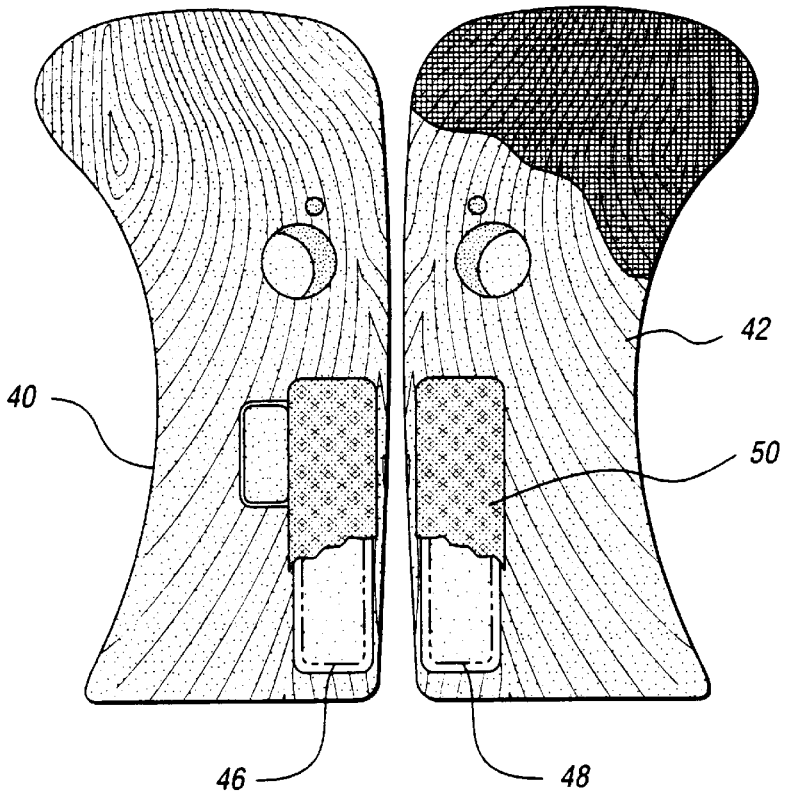
FIG. 6 is a cross-sectional diagram of the head portion shown in FIG. 3.

Head portion 26 is designed to mimic the human sound capturing process and therefore is shaped to resemble a human head. In keeping with the invention, the geometry of head portion 26 allows sound capturing device 22 to localize sound by interpreting sonic data different from every point in space. Of course, sound capturing device 22 may be manufactured in a variety of sizes. In each case, however, the relationships between the various dimensions should remain fairly constant. As shown in FIG. 5, head portion 20 has a height of approximately eight inches and a base width of approximately 3.85 inches. The height/base width ratio is approximately 2:1. If a larger version were desired, say for example 12 inches in height, the relationship between height and width will remain the same resulting in a larger version having a base width of approximately 6.0 inches (12/2). Similarly, if an even larger size head portion is desired, say, for example, 16 inches in height, a base width of approximately 8 inches will be required (16/2).

Referring again to FIG. 3 of the drawings, it can be seen that head portion 26 extends the farthest at its top section 56 (approximately 4.2 inches), next farthest at its base section 58 (approximately 3.75 inches), and is the narrowest at its mid-section 60 (approximately 2.85 inches). The mid-section is the area of head portion 26 where it is intended that the condenser and electret microphones utilized by the present invention should be affixed. It is further evident that the top section 56 has an outer radius of curvature which begins at a height of approximately 5 inches and ends at a height of approximately 7.35 inches. Again, while the size of head portion 26 may be varied, the geometric relationships between the sections of head portion 26 will remain relatively constant. For example, the ratio between the width of the base section 58 (3.75 inches) to the mid-section 60 (2.85 inches) is approximately 1.33:1. Therefore, in a larger sized head portion where it is intended that the base section extends 5.625 inches, for example, the mid-section will extend approximately 4.2 inches (5.625/1.33). Similarly, in a larger version where it is intended that the base extend 7.5 inches, the mid-section will extend approximately 5.6 inches (7.5/1.33).

The ratio between the beginning and ending points of curvature of top section 56 will also remain relatively constant regardless of size. As indicated above, in the embodiment shown in FIGS. 3–6, the top section has a radius of curvature which extends from a height of approximately 5 inches to a height of approximately 7.35 inches, a ratio of approximately 0.68:1. The ratio of the height of the beginning point of curvature (5 inches) to the width of the base section 58 (3.75 inches) is 1.33:1. In a larger sized version, as indicated above, it may be intended for the base section to extend 5.625 inches, the point of curvature should therefore begin at a height of approximately 7.5 inches (5.625×1.33) and should extend to a height of approximately 6.45 inches (7.5/0.68). Similarly, in a larger version where it is intended that the base is on the order of 7.5 inches in width, the mid-section will be approximately 5.7 inches in width (7.5/1.3). As is readily seen, a multitude of geometric relationships and corresponding ratios may be determined with reference to FIGS. 3 and 5. Regardless of the size of head portion 26, however, these ratios will remain relatively constant.

Figure 8:
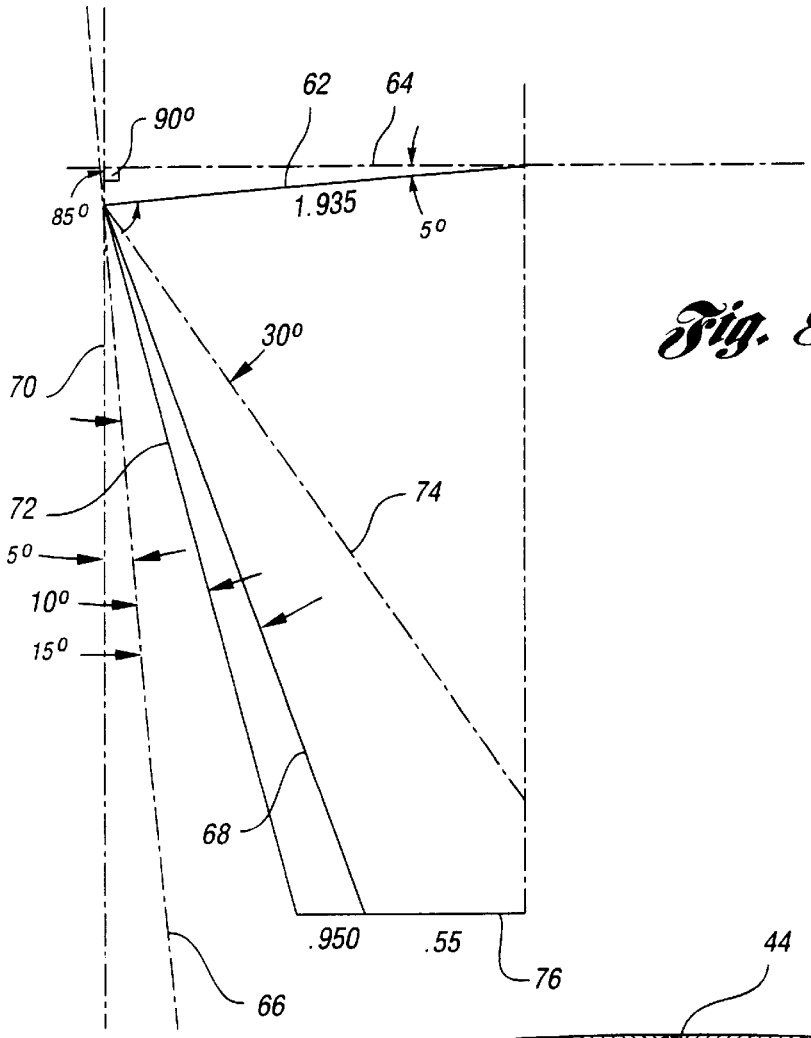
FIG. 8 is a top plan view of the embodiment of the head portion of the sound recording device shown in FIGS. 3–6.
Figure 9:
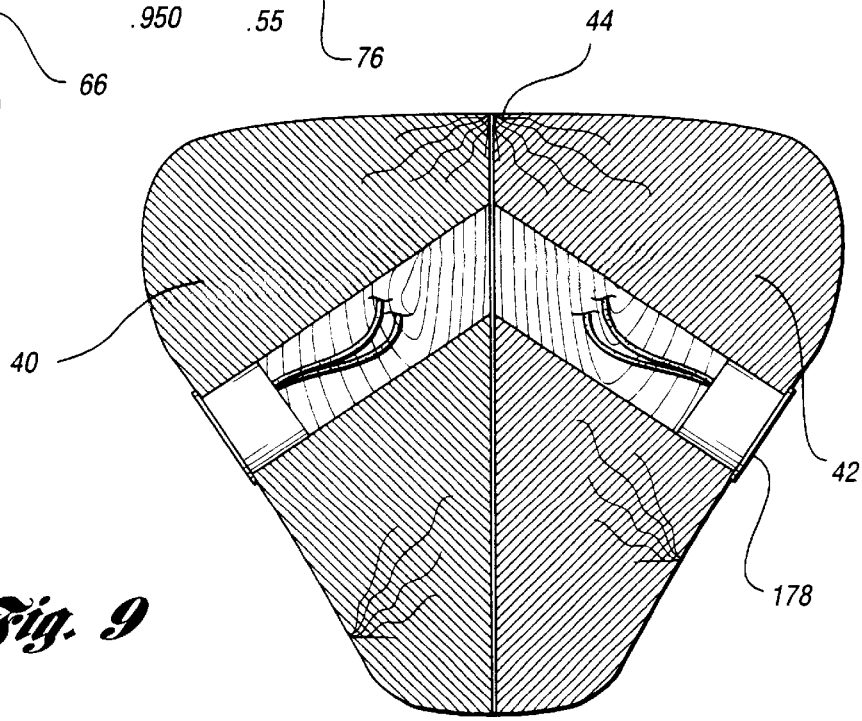
FIG. 9 is a cross-sectional diagram of the head portion shown in FIG. 3 cut along line 10—10.

Referring now to FIG. 8 of the drawings, there is shown a plan view of the head portion 26 shown in FIGS. 3–6. The plan view illustrates that the base section 58 has a rear boundary 62 which extends at an angle of approximately 5° from horizontal reference line 64 and 85° from vertical reference line 70. The side of the base section designated by reference numeral 68 extends at an angle of 15° from reference line 66 which is drawn perpendicular to rear boundary 62. The side boundary 68 of the base section may also be viewed as extended at an angle of 20° from reference line 70 which perpendicular to reference line 64.

Still referring to FIG. 8, it can be seen that the top section 56 has a side boundary 72 which extends at an angle of 10° from reference line 66 and 15° from reference line 70. Finally, the cross-sectional side boundary 74 of the mid-section 60 extends at an angle of 30° from reference line 66 and 35° from reference line 70.

In keeping with the invention, these angles will remain relatively constant regardless of the size of the head portion 26. The geometric relationships between the sizes will also remain relatively constant. For example, it can be seen that the ratio between the width of the rear boundary 62 (1.935 inches) and base section 76 (0.55 inches) is approximately 3.5:1. Thus, in a larger version where it is intended, for example, to have a rear boundary of approximately 2.89 inches in length, the front boundary of the base section will be approximately 0.82 inches (2.89/3.5). The head portion illustrated in FIG. 9 similarly has a rear base boundary to head width of approximately 2:1 (1.935/0.950). Thus, in the larger version mentioned above, where it is intended that the rear boundary have a length of 2.9 inches, the head width will be approximately 1.4 inches (2.89/2). Still further, in the embodiment illustrated, there is a front head width to base width ratio of approximately 1.73:1. Thus, in the larger version where it has been determined that the head width will be approximately 1.4 inches in width, there will be a corresponding front base width of approximately 0.8 inches (1.4/1.73). Again, a multitude of geometric relationships may be determined which, in keeping with the invention, should be maintained regardless of the size of the head portion designed.

Referring again to FIGS. 3–5 and 9 of the drawings, the stereo embodiment of FIG. 2 will be described in further detail. As shown, head portion 26 includes a left crystal microphone 78 and a right crystal microphone 80, each of which is embedded directly therein in the manner illustrated in FIG. 7. At least one condenser (preferably, but not necessarily electret) microphone 82 is further affixed to right side 40 and at least one microphone (preferably, but not necessarily electret) 84 is affixed to left side 42. In keeping with the invention, condenser microphones 82 and 84 are positioned in sufficient proximity to their corresponding crystal microphones 78 and 80, respectively, such that a sound wave will be received by each of the microphones at substantially the same time.

Crystal microphones 78 and 80 are each adapted to generate signals corresponding to the vibrational frequency of body portion 26 in response to a received sound wave. Condenser microphones 82 and 84 are further adapted to generate signals corresponding to a frequency of the received sound wave. As illustrated in FIG. 2, vibrational information and direct sound information from each side 40 and 42 of head portion 26 may be input via cable 37 to a mixer 36 which, in turn, generates right and left channel information for input to a conventional sound recording device 38 via cables 37 and 41.

Figure 10:
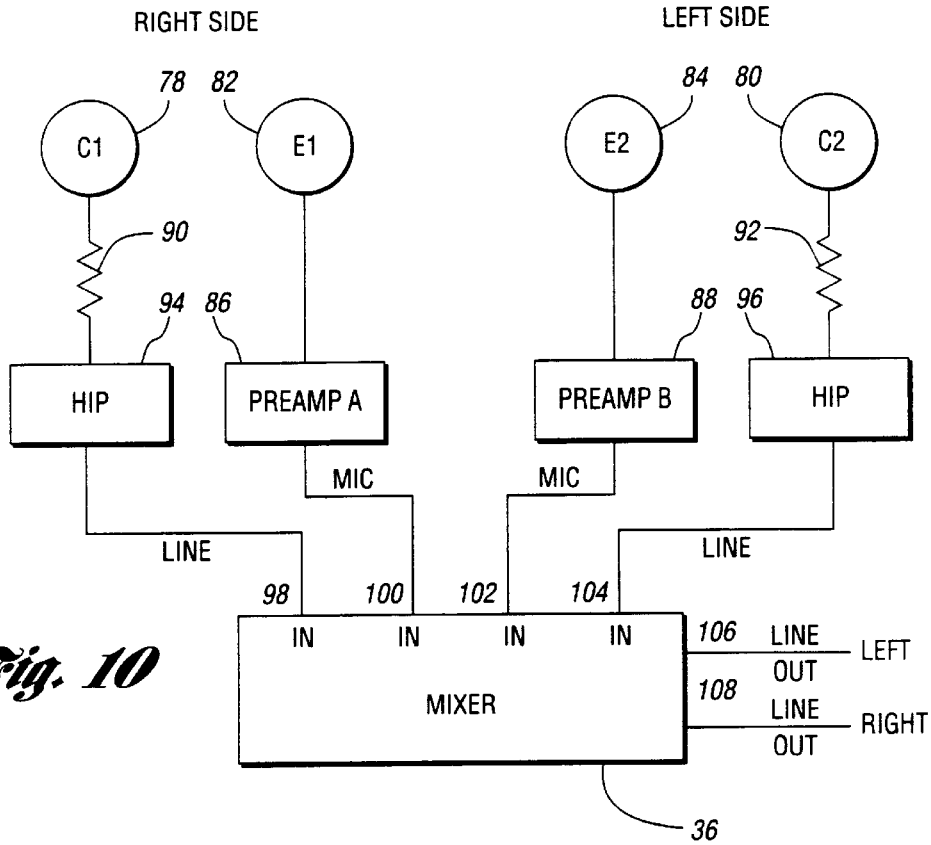
FIG. 10 is a block diagram illustrating the interconnection of the microphones, amplifiers, and mixer used in a first preferred embodiment of the head portion of the present invention.
Figure 11:
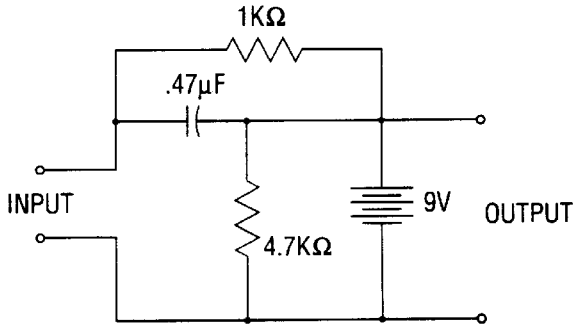
FIG. 11 is a circuit diagram of a representative preamp which may be used in accordance with the teachings of the present invention.
Figure 12:
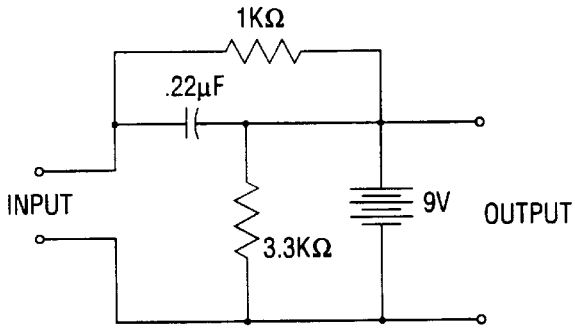
FIG. 12 is a circuit diagram of an alternative preamp which may be used in accordance with the teachings of the present invention.

The internal electrical components associated with the crystal and condenser microphones in the above-described embodiment are shown in greater detail in FIG. 10. For reference purposes, C1 corresponds to crystal microphone 78 and C2 corresponds to crystal microphone 80. Likewise, E1 and E2 correspond to condenser (electret) microphones 82 and 84. Condenser microphones 78 and 80 are each provided in electrical communication with a corresponding preamp A-B designated by reference numerals 86 and 88, respectively. Each of the preamps is, in turn, provided in electrical communication with and provides MIC level input to mixer 36. Preamps 86 and 88 may be of any suitable construction to perform the desired amplification purpose. In the embodiment described, a representative circuit diagram for preamp 86(A) is shown, for example, in FIG. 11. Similarly, a representative circuit diagram for preamp 88(B) is shown in FIG. 12.

Each of the crystal microphones 78 and 80 (C1 and C2) has a corresponding resistor connected across its positive and negative terminals and having an impedance value selected to cause the corresponding crystal microphone to be tuned to reach its maximum sensitivity. While a variety of resistive values may be used depending upon the application, applicant has found that in the embodiment described above, a value in the range of 390 KΩ–1MΩ achieves the desired purpose. It should be understood, however, that different kinds of crystal microphones will require different R values since the tuning process is a function of the crystal.

Each of the resistive elements denominated by reference numerals 90 and 92 in FIG. 10 is further provided in electrical communication with a high impedance preamplifier 94 and 96, respectively for converting the high impedance input of the corresponding crystal microphones 78 and 80 to a line level output to be received by mixer 36.

As seen, mixer 36 has four inputs 98, 100, 102 and 104 and two outputs 106 and 108. Mixer 36, which may comprise, for example, a Stewart 4 mic input mixer, is designed to combine left side body vibration information detected by crystal microphone 80 with left side direct sound information detected by condenser microphone 84 (left channel) and right side body vibration information detected by crystal microphone 78 with right side direct sound information detected by condenser microphone 82 (right channel).

Figure 13:
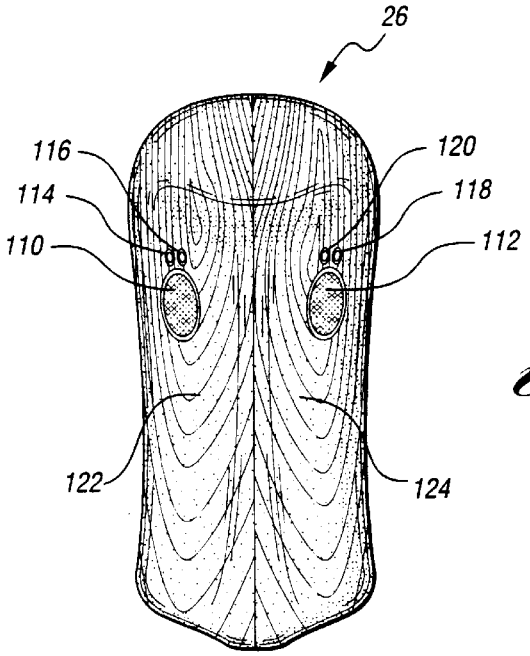
FIG. 13 is a front elevational view of a second preferred embodiment of the head portion of the sound recording device of the present invention.

Turning now to FIG. 13 of the drawings, there is shown a second preferred embodiment of head portion 26 of the present invention. In this embodiment, each of the right and left sides of head portion 26 includes a single crystal microphone 110 (right side) and 112 (left side) and a pair of condensers (preferably, but not necessarily, electret) microphones 114 and 116 (right side) and 118 and 120 (left side). Head portion 26 is, of course, still made of a highly resonant material such as, for example, Engleman spruce wood, and is comprised of a two-piece solid construction having a right side 122 and a left side 124 which are affixed together in the same manner as described above.

In keeping with the invention, condenser microphones 114 and 116 are positioned in sufficient proximity to crystal microphone 110 such that a sound wave will be received by each of the microphones at substantially the same time. Condenser microphones 118 and 120 are similarly positioned in sufficient proximity to crystal microphone 112 so that a sound wave will be received at substantially the same time by each of the microphones. As in the first embodiment described above, crystal microphones 110 and 112 are each adapted to generate signals corresponding to the vibrational frequency of body portion 26 in response to a received sound wave. Again, vibrational information and direct sound information from each side 122 and 124 of head portion 26 may be input to a mixer which, in turn, generates right and left channel information for input to a conventional sound recording device.

Figure 14:
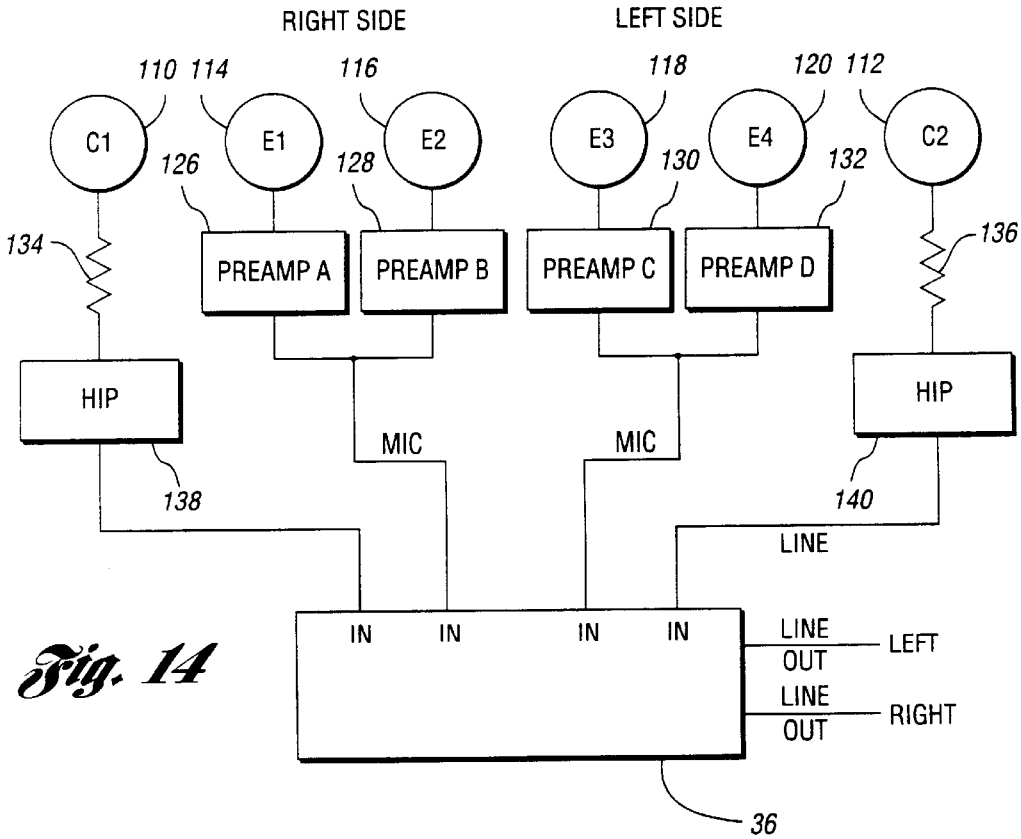
FIG. 14 is a block diagram illustrating the interconnection of the microphones, amplifiers, and mixer used in the second preferred embodiment of the head portion of the present invention.

The internal electrical components associated with the crystal and condenser microphones in this embodiment are shown in greater detail in FIG. 14. For reference purposes, C1 corresponds to crystal microphone 110 and C2 corresponds to crystal microphone 112. Likewise, E1 and E2 correspond to condenser (electret) microphones 114 and 116 and E3 and E4 correspond to condenser (electret) microphones 118 and 120. Condenser microphones 114–120 are each provided in electrical communication with a corresponding preamp A-D designated by reference numerals 126, 128, 130 and 132, respectively. Each of the preamps is, in turn, provided in electrical communication with and provides MIC level input to mixer 36. Preamps 126–132 may be of any suitable construction to perform the desired amplification purpose. In the embodiment described herein, a representative circuit diagram for preamps 126(A) and 132(D) is shown, for example, in FIG. 11. Similarly, a representative circuit diagram for preamps 128(B) and 130 (C) is shown in FIG. 12.

As in the case of the first preferred embodiment, each of the crystal microphones 110 and 112 (C1 and C2) similarly includes a corresponding resistor connected across its positive and negative terminals and having an impedance value selected to cause the corresponding crystal microphone to be tuned to reach its maximum sensitivity. As noted above, a variety of resistive values may be used depending upon the application. Resistive elements 134 and 136 are also provided in electrical communication, respectively, with a corresponding high impedance preamplifier 138 and 140. The high impedance preamplifiers function to convert the high impedance input of the corresponding crystal microphones 110 and 112 to a line level output to be received by mixer 36. Mixer 36 is designed to combine the left side body vibration information detected by crystal microphone 110 with left side direct sound information detected by condenser microphones 114 and 116 (left channel). Mixer 36 further functions to combine right side body vibration information detected by crystal microphone 112 with right side direct sound information detected by condenser microphones 118 and 120 (right channel).

Figure 15:
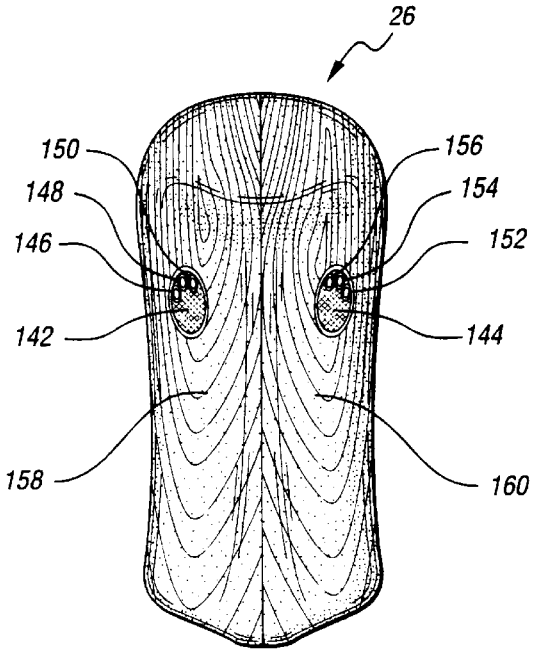
FIG. 15 is a front elevational view of a third preferred embodiment of the head portion of the present invention.

Referring now to FIG. 15 of the drawings, there is shown yet a third preferred embodiment of head portion 26 of the present invention. In this embodiment, each of the right and left sides of head portion 26 includes a single crystal microphone 142 (right side) and 144 (left side) and a group of electret microphones 146, 148 and 150 (right side) and 152, 154, and 156 (left side) which are co-located with their corresponding crystal microphone. Again, head portion 26 is preferably, but not necessarily, made of a highly resonant material such as, for example, Engleman spruce wood, and is comprised of a two-piece solid construction having a right side 158 and a left side 160 which are affixed to one another in the same manner as described above. In keeping with the invention, crystal microphones 142 and 144 are adapted to generate signals corresponding to the vibrational frequency of body portion 26 in response to a received sound wave. Condenser microphones 146–150 (right side) and 152–156 (left side) are further adapted to generate signals corresponding to a frequency of the received sound wave. Vibrational information and direct sound information from each side 158 and 160 of head portion 26 may be input to a mixer which, in turn, generates right and left channel information for input to a conventional sound recording device.

Figure 16:
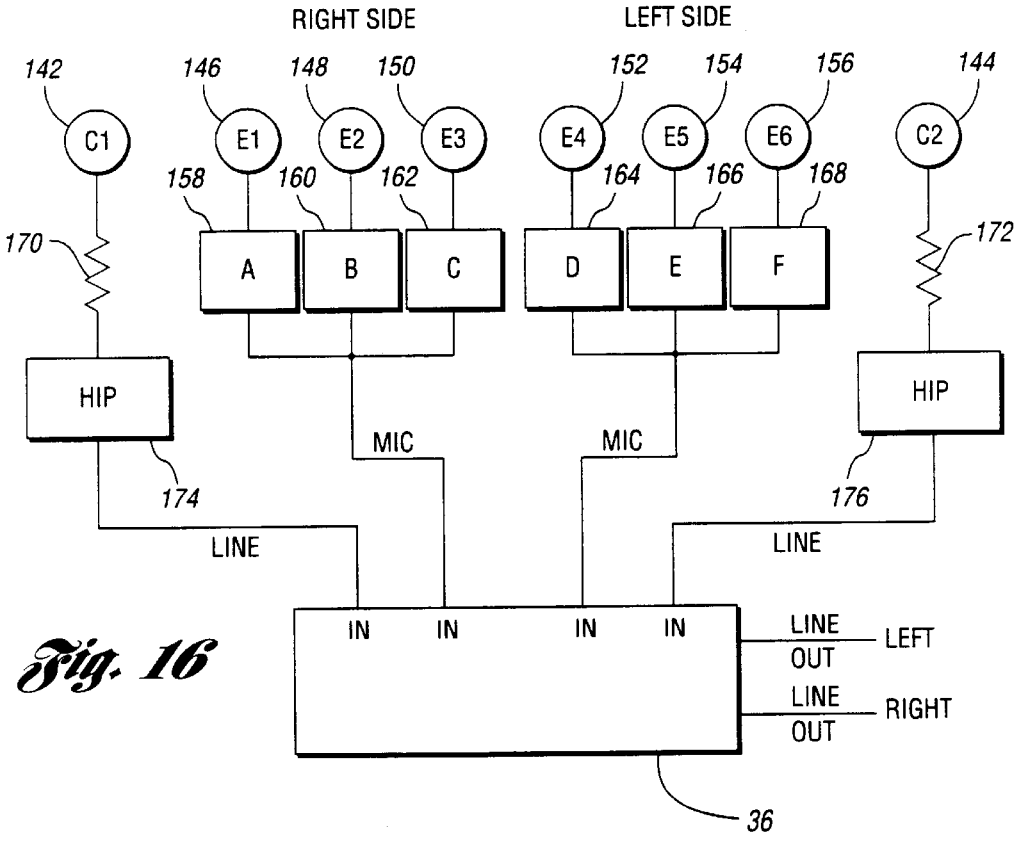
FIG. 16 is a block diagram illustrating the interconnection of the microphones, amplifiers, and mixer used in the third preferred embodiment of the present invention.

The internal electrical components associated with the crystal and condenser microphones in this described embodiment are shown in greater detail in FIG. 16. For reference purposes, C1 corresponds to crystal microphone 142 and C2 corresponds to crystal microphone 144. Likewise, E1, E2, and E3 correspond to condenser (electret) microphones 146, 148 and 150. E4, E5, and E6 correspond to condenser (electret) microphones 152, 154, and 156. Condenser microphones 146, 148 and 150 are each provided in electrical communication with a corresponding preamp A-C designated by reference numerals 158, 160 and 162, respectively. Each of the preamps is, in turn, provided in electrical communication with and provides MIC level input to mixer 36. Condenser microphones 152, 154 and 156 are similarly provided in electrical communication with a corresponding preamp D-F designated by reference numerals 164, 166 and 168, respectively. Each of the preamps 164–168 is provided in electrical communication with and provides mic level input to mixer 36 as well. Preamps 158–168 may be of any suitable construction to perform the desired amplification purpose. In the embodiment described, a representative circuit diagram of preamps 158, 162, 166 and 168 (A, C, E and F) is shown in FIG. 11. Similarly, a representative circuit diagram for preamps 160(B), 164(D) is shown in FIG. 12.

As in the previous embodiments, each of the crystal microphones 142 and 144 (C1 and C2) has a corresponding resistor connected across its positive and negative terminals and having an impedance value selected to cause the corresponding crystal microphone to be tuned to reach its maximum sensitivity. As noted above, a variety of resistive values may be used depending upon the application. Each of the crystal microphones 142 and 144 similarly is connected to a resistive element 170 and 172, respectively, which, in turn, is provided in electrical communication with a high impedance preamplifier 174 and 176. The high impedance preamplifiers are operative to convert the high impedance input of the corresponding crystal microphones 142 and 144 to a line level output to be received by mixer 36.

Figure 7:
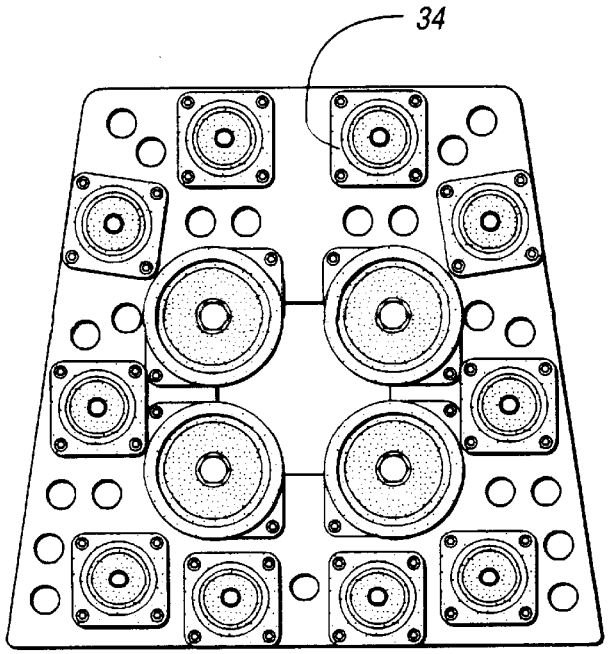
FIG. 7 is a top elevational view of the mounting plate of the sound recording device shown in FIG. 1.
Figure 17:
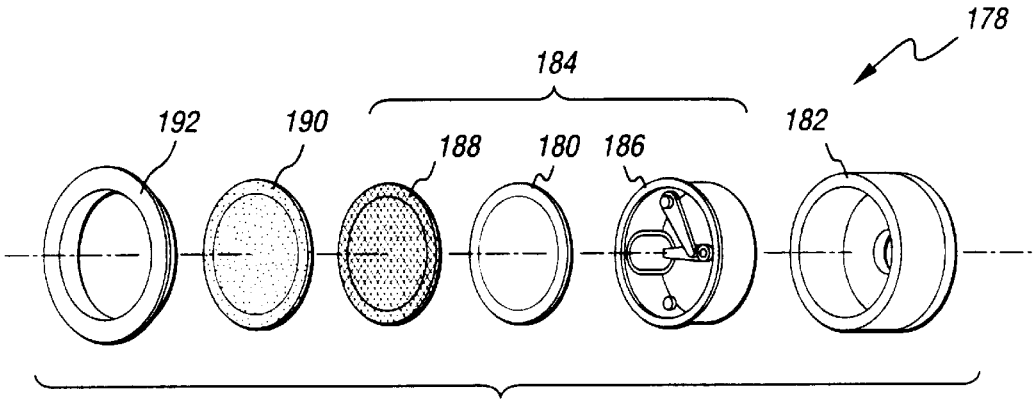
FIG. 17 is an exploded perspective view of a representative crystal microphone used in accordance with the teachings of the present invention to detect body vibration information.

The detailed construction of a crystal microphone suitable for use with the present invention is shown, for example, in FIG. 17. Microphone 178 is designed to work on a transducer principle wherein its aluminum diaphragm 180 is mechanically coupled directly to head portion 26 so as to extend its dimensions as shown in FIG. 7. Conventional crystal microphones include substantial vibration isolation components so that the received sound information is not affected by movement, i.e. vibration of the microphone. It is this vibration information, however, which is sought to be detected by the present invention. Manufacturing vibration isolation componentry is, therefore, removed such that all vibration information may be received.

Referring still to FIG. 17, crystal microphone 178 comprises a base member 182 which is adapted to receive the components of a conventional crystal microphone, designated generally by reference numeral 184, including receptacle 186, diaphragm 180 and cover 188. The functionality and operation of crystal microphone 178 is known to those skilled in the art and need not be addressed in further detail here. Vibration system, i.e., crystal microphone 178, further includes a cover 190 and coupling 192 which is adapted to mate with base member 126.

The condenser microphones discussed above are all of a conventional type and are therefore not shown in detail. By way of background, however, it is understood that an electret is a material that retains a permanent electric polarization such that it has one end that is positively charged and another end that is negatively charged. The electret microphone consists of an electric foil which is normally a thin plastic membrane having an even thinner layer of metal evaporated onto it and stretched over a metal plate. The plate is generally perforated and touches the foil only at selected points leaving shallow pockets of air which permit the foil to move back and forth. The foil has a permanent charge on it, which creates an electric field between the foil and the plate. Sound waves hitting the foil cause it to vibrate thus changing the electric field and generating a small current that fluctuates in direct proportion to the changing sound pressure waves.

Figure 18:
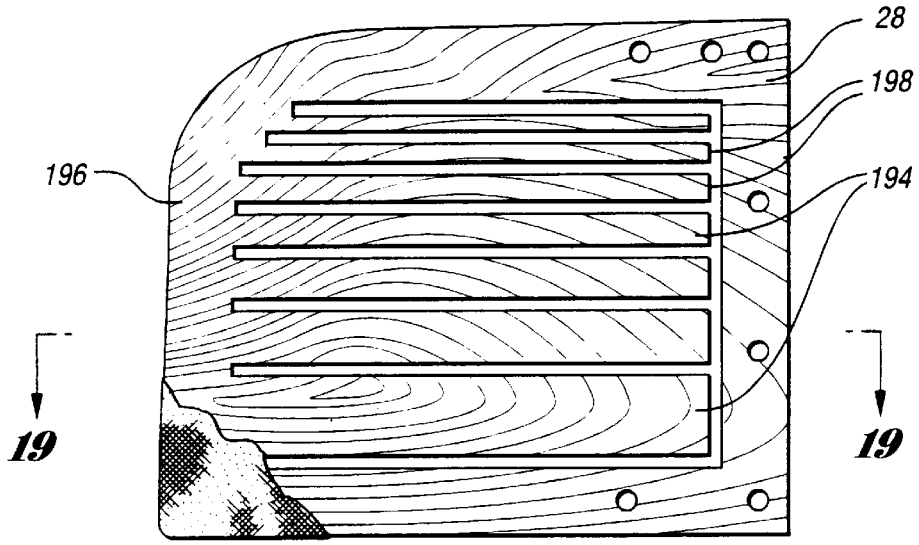
FIG. 18 is a front elevational view of the left element of the torso portion of the sound recording device of FIG. 1 shown with the protective cover substantially removed.
Figure 19:
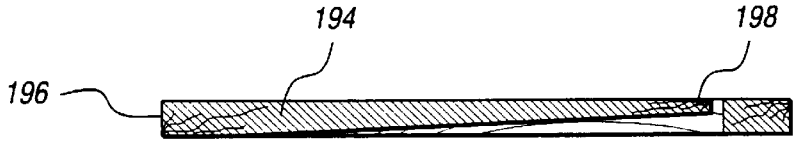
FIG. 19 is a cross-sectional diagram of the torso portion shown in FIG. 6 cut along line 20—20.

Referring now to FIGS. 18 and 19 of the drawings, a left side element of torso portion 28 is shown in greater detail. Like head portion 26, torso portion 28 is preferably, but not necessarily, comprised of a left and right plate and is made of Engleman spruce or other suitable material or composite. Torso portion 28, and in particular, its right and left elements, may be affixed to head portion 26 by nylon bolts (not shown) or other suitable means.

As a feature of the invention, each of the plates include a plurality of ribs 194 each having a common fixed edge 196 and a free edge 198. Ribs 194 are constructed to be of varying mass such that they vibrate without significant, if any, oscillation.

While the best mode for carrying out the invention has been described in detail, those familiar with the art to which this invention relates will recognize various alternative designs and embodiments for practicing the invention as defined by the following claims.

What is claimed is:

1. A sound capturing device, comprising:

a body portion geometrically configured to simulate the acoustic properties of a human head and torso;

a first microphone coupled to the body portion for generating a first signal corresponding substantially to a vibrational frequency of said body portion in response to a received sound wave; and a second microphone affixed to the body portion and integral with the first microphone for generating a second signal corresponding substantially to a frequency of said received sound wave such that said sound wave will reach the first and second microphones at substantially the same time.

2. A sound capturing device, comprising:

a body portion geometrically configured to simulate the acoustic properties of a human head and torso;

a crystal microphone affixed to the body portion for generating a first signal corresponding substantially to a vibrational frequency of said body portion in response to a received sound wave; and a condenser microphone affixed to the body portion and integral with the crystal microphone for generating a second signal corresponding substantially to a frequency of said received sound wave such that said sound wave will reach the crystal microphone and the condenser microphone at substantially the same time.

* * * * *